United States Patent [19]

Hemfort

[11] 4,017,023

[45] Apr. 12, 1977

[54] SELF-CLEANING AIR-TIGHT CENTRIFUGAL SEPARATOR

[75] Inventor: Heinrich Hemfort, Oelde, Germany

[73] Assignee: Westphalia Separator Aktiengesellschaft, Oelde Westphalia, Germany

[22] Filed: Feb. 23, 1976

[21] Appl. No.: 660,541

[30] Foreign Application Priority Data

Feb. 27, 1975 Germany ..... 2508503

[52] U.S. Cl. ..... 233/1 A; 233/20 R

[51] Int. Cl.[2] ..... B04B 11/02

[58] Field of Search ..... 233/19 R, 19 A, 20 R, 233/20 A, 1 A, 1 R, 27

[56] References Cited

UNITED STATES PATENTS

| | | | |
|---|---|---|---|
| 3,117,928 | 1/1964 | Thylefors | 233/20 R |
| 3,179,334 | 4/1965 | Sharples | 233/20 R |
| 3,930,609 | 1/1976 | Nelson | 233/20 A |

*Primary Examiner*—George H. Krizmanich
*Attorney, Agent, or Firm*—Burgess, Dinklage & Sprung

[57] ABSTRACT

Self-cleaning, air-tight drum centrifuge (1*a*) having flange packing (4) between the stationary discharge conduit (2) for clarified liquid and the rotating neck (7*a*) of the drum 7. Leaking of air past packing 4, when solids are discharged from the drum in the intermittent self-cleaning step and a vacuum develops in the drum chamber 7*b*, is prevented by providing in the passageway (11*a*) between the drum chamber 7*b* and the discharge conduit 2, a siphon-like section 11. By properly dimensioning the siphon-like section, pressure of more than 1 atmosphere is maintained in the liquid contained in the siphon-like section, whereby such leaking is prevented.

4 Claims, 1 Drawing Figure

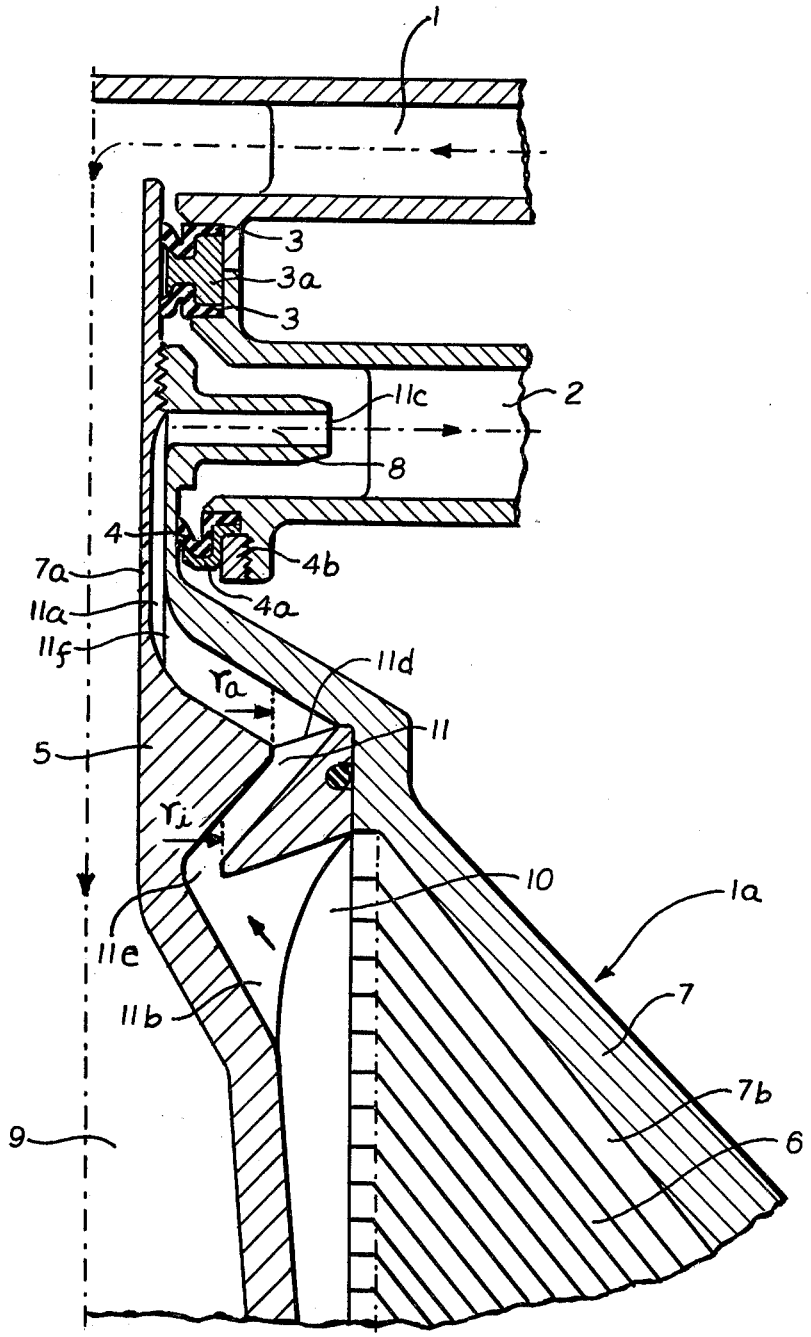
1
3
3a
3
11c
2
8
4
4b
7a
4a
11a
11f
11d
$r_a$
11
5
$r_i$
10
1a
11e
7
11b
7b
9
6

SELF-CLEANING AIR-TIGHT CENTRIFUGAL SEPARATOR

BACKGROUND

The invention relates to a self-cleaning, air-tight centrifugal separator in which the connection of the rotating drum chamber to the stationary discharge fitting is sealed by means of a flange packing. The flange packing, which is tightly clamped in the stationary discharge fitting surrounding the drum, has an annular flange of U-shaped cross-sectional profile, which is urged tightly against the neck of the drum by the pressure of a liquid. A centrifugal separator of this kind is described, for example, in German Pat. No. 1,094,193.

Centrifugal separators of the air-tight type are used mostly for the processing of liquids which must be preserved against contact with air so as to prevent oxidation.

Due to the airtight packing, the drums of separators of this type fill up completely with liquid shortly after they are started up, because the air that is in them is quickly expelled by the incoming liquid. As operation continues, then, contact with the atmospheric air is excluded.

In the beverage industry, self-cleaning, air-tight centrifugal separators are operated in most cases with intermittent partial ejection of the solids, that is to say, at relatively short intervals of time, e.g., every three minutes, only a portion of the solids separated from the liquid is ejected, while the remainder is retained in the drum as a safety seal to prevent the leakage of valuable liquid. Therefore, during such partial ejections there is no need to shut off the raw liquid feed, as there is when solids are ejected all at once.

The speed of the ejection of the solids, disregarding internal friction, is equal to the circumferential speed of the drum, so that in only one second a relatively large amount of the solids accumulated in the drum is ejected, whereupon an airless void is formed in the central part of an air-tight drum, producing a corresponding suction effect.

Let it be assumed that a separator is fed with raw liquid at a rate of 24,000 l/hr, i.e., at 6.66 l/sec, and when a partial ejection is performed 18 liters of solids are ejected in one second. An airless void then forms in the central part of the drum, whose volume is 18 l, minus the amount of liquid entering the drum in the meantime; the latter amount, however, due to the suction effect, will be greater than 6.66 l, unless a volumetric pump is installed in the feed line. If the overfeed amounts to 10 l/sec, there will still remain an airless void of 8 liters seeking equilibrium with the atmosphere.

With regard to the pumping of the clarified liquid through the discharge line, there are essentially two types of construction.

In the one type of construction, the feed pump forces the raw liquid through the drum and the discharge line. The liquid is thus under pressure throughout, and also forces the flange of the packing tightly against the neck of the drum. But when an airless void is formed in the drum during the partial ejection of solids, the pumping pressure can no longer propagate itself all the way into the discharge line, and the discharge line thus loses pressure, whereupon the packing flange lifts away from the neck of the drum so that air is sucked into the drum. The fact that in this case a portion of the clarified liquid may be sucked back into the drum can be disregarded.

In the other type of construction, there is provided in the stationary discharge fitting a special chamber in which a centrifugal pump impeller rotates with the drum. The feed pump forces the liquid all the way into this chamber, from which it is then pumped by the centrifugal pump impeller. When an airless void forms during the partial ejection of solids, the pressure is removed from the packing flange and the flange is lifted away from the drum neck so that, in this case, too, air can be drawn into the drum. The difference between this and the first type of construction described is that in this case clarified liquid cannot be sucked back from the discharge line.

The density of air at atmospheric pressure is 1.29 mg. $\times$ cm$^{-3}$, and its oxygen content is 21%. If 8 l of air is sucked into the drum during a partial ejection of the solids, this corresponds to a quantity of 2167.2 mg of oxygen. At the throughput of 24,000 l/h mentioned in the beginning, 1,200 l of liquid flows through the drum in a centrifuging period of 3 minutes. The air that is sucked in mixes with this amount of liquid, so that the oxygen content of the liquid amounts to 1.8 mg/l. Breweries, however, strive for an oxygen content of less than 0.15 mg/l, which cannot be achieved under the conditions of the types of construction known hitherto. However, with smaller ejections of solids and longer centrifuging periods the above requirement can largely be satisfied.

The invention is addressed to the problem of designing a centrifugal separator of the kind described, in such a manner that no aspiration of atmospheric air will be possible during the partial ejections of solids. This is accomplished in accordance with the invention by the fact that a liquid seal is provided, which can maintain at least an equilibrium with an external excess pressure of 1 atmosphere.

Liquid seals are known in connection with non-air-tight centrifugal separators. For example, British Pat. No. 675,648 shows a chamber located above the paring chamber and rotating with the drum, this chamber being filled at least partially with liquid in which a stationary disk is immersed. In this manner, outside air is prevented from entering the paring chamber and thus from reaching the passages in the paring disk.

In this known system, virtually the same pressure prevails in the sealing chamber above and below the immersed disk. Its purpose, therefore, is not to seal a vacuum in the drum chamber against the atmospheric pressure, because in this known drum no vacuum can form in the drum chamber. The sealing chamber is also independent of the clarified liquid circuit.

THE INVENTION

The drum of the centrifugal separator of the invention is characterized by a liquid seal, which is known, disposed at the upper end of the drum, the discharge passages being of a siphon-like construction, and the inside diameter of the inlet edge of the siphon-like construction and the outside diameter of the portion defining the siphon bend being so dimensioned that the liquid column extending between these diameters will produce a pressure of more than one atmosphere.

If $r_i$ is the inside radius of the inlet edge of the siphon-like construction, $r_a$ the outside radius of the portion defining the siphon bend, $\rho$ the density of the liquid, and $\omega$ the angular velocity of the drum, then the liquid pressure at the distance $r_a$ from the axis of rotation will be:

$$P = \frac{\rho \cdot \omega^2}{2} (r_a^2 - r_i^2).$$

If this pressure is to amount to at least 1 atmosphere, then $r_a^2$ minus $r_i^2$ must be equal to or greater than $$\frac{2\,kp}{\rho\,\omega^2}$$

if 1 atmosphere is taken to be equal to 1 kp × $cm^{-2}$.

The invention will be further described in conjunction with the drawing, which shows an embodiment of the centrifugal separator of the invention, specifically the upper right half of a perpendicular cross section taken through an air-tight, self-cleaning centrifuge 1*a*.

Inlet conduit 1 and outlet conduit 2 serve, respectively, for the input and output of the liquid being processed and are disposed in the stationary part of the separator. The inlet and outlet are sealed with respect to the rotating part of the centrifuge, shortly to be described, by packings 3 and 4 of U-shaped cross-sectional profile. With the aid of backing members 3*a*, 4*a*, 4*b*, the packings are fixedly mounted in the stationary part and simultaneously seal the conduits with respect to the rotating part of the centrifuge. Such construction is known in the art. The flange packing 4 is formed of pliable material so that the flange packing can flex in response to a pressure differential between the outlet conduit 2 and the atmosphere.

The rotating part of the centrifugal separator comprises the drum 7 which provides chamber 7*b*, the disk stack 6 and the distributor 5 plus the discharge pump impeller 8. The liquid to be clarified is delivered under pressure through the feed conduit 1 and the inlet 9 defined by the distributor 5 to the disk stack 6 in a known manner. The clarification of the liquid takes place in the disk stack 6, and the solid matter is driven by centrifugal force into the outer part of the drum chamber, and, in the operation of the self-cleaning centrifuge, it is periodically ejected. Such a separator is disclosed in U.S. Pat. No. 3,593,915.

The clarified liquid passes through a collecting chamber 10, and through the siphon-like section 11, to the discharge pump impeller 8, and it is discharged through conduit 2.

When the desludging procedure is performed in the drum, the liquid level in the collecting chamber 10 and the disk stack 6 recedes toward the periphery of the drum by a volume equal to that of the solid or liquid let out, so that a corresponding vacuum develops within the drum. Since in the portion of siphon-like construction in accordance with the invention, a liquid seal remains if the inside radius $r_i$ of the inlet edge of siphon-like section 11 and the outside radius $r_a$ of the portion defining the siphon bend are properly dimensioned, the vacuum will not be transferred to the discharge conduit 2 and this will prevent any lifting of the packing 4 from the rotating neck 7*a* of the drum and consequently will forestall any aspiration of atmospheric air or oxygen. The flange packing 4 is of such form that pressure in the discharge conduit 2 tends to press the packing against the rotating drum, e.g. against the neck 7*a*.

SUMMARY

Thus, with reference to the drawing only for exemplification, the invention is directed to a self-cleaning, air-tight centrifugal separator 1*a* comprising a rotating drum 7 providing a chamber 7*b* for the separation, and a passageway 11*a* in the drum having an inlet end 11*b* for receiving clarified liquid from the chamber and a discharge end 11*c* for discharge of the clarified liquid from the rotating drum. A stationary discharge conduit 2 is connected to the drum 7 for receiving the clarified liquid from the discharge end 11*c* of the passageway 11*a*, and a flange packing 4 is interposed between the discharge end of the passageway and the stationary conduit for providing an air-tight seal therebetween. The flange packing is of such construction that it is urged so as to provide the seal by the pressure of the clarified liquid. The invention provides the improvement which comprises the passageway 11*a* having a siphon-like section 11 between the passageway inlet end 11*b* and discharge end 11*c* for formation of a liquid seal between the passageway discharge end 11*c* and the drum chamber. The siphon-like section can be disposed so that the siphon bend 11*d* is radially outward of the siphon inlet end 11*e* and outlet end 11*f*.

According to the invention, the inside diameter of the inlet edge of the siphon-like section and the outside diameter of the portion defining the siphon bend are such that the clarified liquid extending between these diameters in the siphon-like section 11 produces a pressure in excess of one atmosphere.

What is claimed is:

1. In a self-cleaning, air-tight centrifugal separator comprising:

a rotating drum providing a chamber for the separation, a passageway in the drum having an inlet end for receiving clarified liquid from the chamber and a discharge end for discharge of the clarified liquid from the rotating drum, a stationary discharge conduit connected to the drum for receiving the clarified liquid from the discharge end of said passageway, and a flange packing interposed between the discharge end of said passageway and the stationary conduit for providing an air-tight seal therebetween, the flange packing being of such construction that it is urged so as to provide said seal by the pressure of the clarified liquid, the improvement which comprises:

said passagewaying having a siphon-like section between passageway inlet end and discharge end for formation of a liquid seal between the passageway discharge end and the drum chamber the siphon-like section being disposed so that the siphon bend is radially outward of the siphon inlet end and outlet end.

2. Centrifuging a liquid mixture to separate a clarified liquid therefrom, in a centrifuge according to claim 1, and wherein the inside diameter of the inlet edge of the siphon-like section and the outside diameter of the portion defining the siphon bend are such that the clarified liquid extending between these diameters in the siphon-like section produces a pressure in excess of one atmosphere.

3. Separator of claim 1, wherein the siphon-like section is such that said liquid seal can maintain at least an equilibrium with an external excess pressure of 1 atmosphere.

4. Centrifuging according to claim 2, the siphon-like section being such that said liquid seal can maintain at least an equilibrium with an external excess pressure of 1 atmosphere.

* * * * *

UNITED STATES PATENT AND TRADEMARK OFFICE

CERTIFICATE OF CORRECTION

PATENT NO. : 4,017,023

DATED : April 12, 1977

INVENTOR(S) : Heinrich Hemfort

It is certified that error appears in the above-identified patent and that said Letters Patent are hereby corrected as shown below:

Column 4, line 47, change "passagewaying" to --passage-way--.

Signed and Sealed this twelfth Day of July 1977

[SEAL]

*Attest:*

RUTH C. MASON
*Attesting Officer*

C. MARSHALL DANN
*Commissioner of Patents and Trademarks*